US009512678B2

(12) United States Patent
Valsecchi et al.

(10) Patent No.: US 9,512,678 B2
(45) Date of Patent: Dec. 6, 2016

(54) SYSTEM AND METHOD OF EXECUTING AN UNDERWATER WELL DRILLING PROGRAM IN THE BED OF A BODY OF WATER, AND AUXILIARY FLOATING UNIT

(71) Applicant: SAIPEM S.p.A., San Donato Milanese (IT)

(72) Inventors: Alessandro Valsecchi, San Donato Milanese (IT); Luigi Lanfranchi, San Donato Milanese (IT)

(73) Assignee: SAIPEM S.P.A, San Donato Milanese (IT)

( * ) Notice: Subject to any disclaimer, the term of this patent is extended or adjusted under 35 U.S.C. 154(b) by 0 days.

(21) Appl. No.: 14/358,544

(22) PCT Filed: Nov. 23, 2012

(86) PCT No.: PCT/IB2012/056692
§ 371 (c)(1),
(2) Date: May 15, 2014

(87) PCT Pub. No.: WO2013/076706
PCT Pub. Date: May 30, 2013

(65) Prior Publication Data

US 2014/0326503 A1 Nov. 6, 2014

(30) Foreign Application Priority Data

Nov. 23, 2011 (IT) ..... MI2011A2130

(51) Int. Cl.
*E21B 7/12* (2006.01)
*E21B 7/128* (2006.01)
(Continued)

(52) U.S. Cl.
CPC ..... *E21B 7/128* (2013.01); *E02B 17/021* (2013.01); *E02B 2017/006* (2013.01); *E02B 2017/0082* (2013.01)

(58) Field of Classification Search
CPC ..... E21B 7/128; B63B 35/44
(Continued)

(56) References Cited

U.S. PATENT DOCUMENTS 3,104,531 A * 9/1963 McCammon ..... 405/196
3,327,668 A * 6/1967 Von Schultz ..... 114/265
(Continued)

FOREIGN PATENT DOCUMENTS

GB 2080860 2/1982
JP 6095017 5/1985
(Continued)

OTHER PUBLICATIONS

International Search Report and Written Opinion for International Application No. PCT/IB2012/056692 dated Aug. 1, 2013.
(Continued)

*Primary Examiner* — Matthew R Buck
*Assistant Examiner* — Aaron Lembo
(74) *Attorney, Agent, or Firm* — Neal, Gerber & Eisenberg LLP

(57) ABSTRACT

A system configured to execute an underwater well drilling program in the bed of a body of water has a jack-up having a floating structure and a drilling installation supported on the floating structure; and an auxiliary floating unit connectable selectively to the jack-up to enable transfer of the jack-up over the body of water, even in very shallow water.

11 Claims, 5 Drawing Sheets

(51) Int. Cl.
*E02B 17/02* (2006.01)
*E02B 17/00* (2006.01)

(58) Field of Classification Search
USPC ..... 175/7; 166/352, 358; 114/264–266; 405/196, 203
See application file for complete search history.

(56) References Cited

U.S. PATENT DOCUMENTS

| | | | | |
|---|---|---|---|---|
| 3,716,993 | A * | 2/1973 | Sumner | 405/198 |
| 3,837,309 | A * | 9/1974 | Biewer | 114/265 |
| 3,974,657 | A * | 8/1976 | Sumner | 405/209 |
| 3,986,471 | A * | 10/1976 | Haselton | 114/265 |
| 4,534,678 | A * | 8/1985 | Nakazato et al. | 405/204 |
| 4,648,751 | A * | 3/1987 | Coleman | 405/209 |
| 4,854,778 | A * | 8/1989 | Valenzuela | 405/204 |
| 4,907,912 | A * | 3/1990 | Smith | 405/208 |
| 5,237,949 | A * | 8/1993 | Stevens et al. | 114/265 |
| 5,342,148 | A * | 8/1994 | Huete et al. | 405/223.1 |
| 6,276,876 | B1 * | 8/2001 | Bone et al. | 405/205 |
| 6,340,272 | B1 * | 1/2002 | Runge et al. | 405/203 |
| 6,374,764 | B1 * | 4/2002 | Davenport et al. | 114/265 |
| 6,375,391 | B1 * | 4/2002 | Borseth et al. | 405/224.4 |
| 6,575,665 | B2 * | 6/2003 | Richter et al. | 405/195.1 |
| 7,850,398 | B2 * | 12/2010 | Foo et al. | 405/212 |
| 7,854,570 | B2 * | 12/2010 | Heidari | 405/223.1 |
| 7,934,462 | B2 * | 5/2011 | Mansour et al. | 114/264 |
| 7,958,835 | B2 * | 6/2011 | Srinivasan | 114/264 |
| 8,403,058 | B2 * | 3/2013 | Nadarajah et al. | 166/365 |
| 8,511,246 | B2 * | 8/2013 | Srinivasan | 114/264 |
| 8,517,637 | B2 * | 8/2013 | Thomas et al. | 405/209 |
| 8,807,875 | B2 * | 8/2014 | Shafer et al. | 405/227 |
| 8,851,799 | B2 * | 10/2014 | Noble et al. | 405/226 |
| 8,870,497 | B2 * | 10/2014 | Shafer et al. | 405/227 |
| 8,875,805 | B2 * | 11/2014 | Advocaat et al. | 175/5 |
| 8,899,880 | B2 * | 12/2014 | Foo et al. | 405/196 |
| 8,911,179 | B2 * | 12/2014 | Noble et al. | 405/217 |
| 9,033,617 | B2 * | 5/2015 | Perol et al. | 405/203 |
| 2006/0275080 | A1 * | 12/2006 | Li et al. | 405/13 |
| 2009/0208294 | A1 * | 8/2009 | Yao et al. | 405/196 |
| 2011/0305521 | A1 * | 12/2011 | Henstra et al. | 405/198 |
| 2012/0125688 | A1 * | 5/2012 | Noble et al. | 175/57 |
| 2012/0125690 | A1 * | 5/2012 | Noble et al. | 175/75 |
| 2015/0101522 | A1 * | 4/2015 | Younan et al. | 114/264 |

FOREIGN PATENT DOCUMENTS

| | | |
|---|---|---|
| NL | 7510126 | 3/1976 |
| WO | WO 2004/046467 | 6/2004 |

OTHER PUBLICATIONS

Notification Concerning Submission, Obtention or Transmittal of Priority Document (Form PCT/IB/304) for International Application No. PCT/IB2012/056692 dated Mar. 6, 2013.

* cited by examiner

SYSTEM AND METHOD OF EXECUTING AN UNDERWATER WELL DRILLING PROGRAM IN THE BED OF A BODY OF WATER, AND AUXILIARY FLOATING UNIT

PRIORITY CLAIM

This application is a national stage application of PCT/IB2012/056692, filed on Nov. 23, 2012, which claims the benefit of and priority to Italian Patent Application No. MI2011A 002130, filed on Nov. 23, 2011, the entire contents of which are each incorporated by reference herein.

BACKGROUND

A jack-up is a mobile well-drilling marine unit, which can float and be towed to a designated drilling station, where the legs are lowered to rest the feet on the bed of the body of water, or drive the feet in, when working on soft beds. The floating structure is then raised above the surface of the water, to above maximum wave and/or tide level; and, once the jack-up is supported firmly on the bed of the body of water, drilling of the bed is commenced.

A drilling program comprises drilling a plurality of wells in designated locations spread over a designated area. The operating range of the jack-up depends on its structural characteristics. More specifically, the maximum length of its legs depends on how the jack-up is constructed, and the maximum water depth jack-ups can operate in rarely exceeds a hundred meters, whereas the minimum drilling depth is normally about six meters, and depends on the jack-up's tonnage and draught.

Drilling programs sometimes call for drilling with a jack-up in very shallow water, (i.e., shallower than the minimum allowed by the jack-up's tonnage and draught); in which case, other types of jack-ups must be used, thus greatly increasing overhead of the drilling program as a whole.

SUMMARY

The present disclosure relates to a system configured to execute an underwater well drilling program in the bed of a body of water.

The system of various embodiments of the present disclosure comprises a jack-up of the type comprising a plurality of legs; a plurality of feet, each configured to rest on the bed of the body of water; a floating structure connected to move selectively with respect to each leg to vary the configuration of the floating structure, with respect to the body of water, between a plurality of positions comprising a floating position, in which the legs substantially extend above the floating structure; at least one deck over the floating structure; and at least one drilling installation.

It is an advantage of the present disclosure to provide a system configured to execute an underwater well drilling program, configured to reduce certain of the drawbacks of certain of the known art.

According to the present disclosure, there is provided a system configured to execute an underwater well drilling program in the bed of a body of water; the drilling system comprising a jack-up having a floating structure, and a drilling installation supported on the floating structure; and an auxiliary floating unit connectable selectively to the jack-up.

In various embodiments of the present disclosure, the buoyancy of the jack-up can be altered, when necessary, to enable the jack-up to be set up and drill in relatively shallow, otherwise unreachable, water.

In one embodiment of the disclosure, the jack-up comprises a plurality of legs; and a plurality of feet, each located at the bottom end of a leg and configured to rest on the bed of a body of water; the floating structure being connected to move selectively with respect to each of the legs to vary the configuration of the jack-up between a first configuration, in which the legs only extend above the floating structure, and a plurality of second configurations, in which the legs support the floating structure on the bed of the body of water and above the surface of the body of water; the auxiliary floating unit being connectable selectively to the floating structure.

In various embodiments of the present disclosure, the floating structure and the auxiliary floating unit are connected to increase buoyancy.

In one embodiment of the disclosure, the jack-up and the auxiliary floating unit are complementary in shape.

The complementary configuration of the auxiliary floating unit and the floating structure safeguards against improper connection resulting in unstable buoyancy.

In one embodiment of the disclosure, the auxiliary floating unit comprises two tanks configured to be located on opposite sides of the jack-up; and at least one connecting member configured to connect the tanks to each other, and configured to be located beneath the floating structure.

The connecting member provides for transmitting buoyancy to an extensive area of the floating structure, and so preventing concentrated local stress.

In one embodiment of the disclosure, the floating structure comprises a seat configured to at least partly house the auxiliary floating unit.

The auxiliary floating unit can thus be set in a designated position with respect to the jack-up, to improve stability of the floating assembly formed by the jack-up and the auxiliary floating unit.

In various embodiments, the jack-up has a first barycentre substantially aligned vertically with the buoyancy application point of the floating structure; the auxiliary floating unit has a second barycentre substantially aligned vertically with its own buoyancy application point; and the jack-up and auxiliary floating unit are connected, to form a stable buoyancy system, as a function of the positions of the first and second barycentre and the buoyancy application points.

Determining a designated position of the auxiliary floating unit with respect to the jack-up, in fact, enables a stable overall assembly to be achieved.

In one embodiment of the disclosure, the auxiliary floating unit comprises at least one controlled-flooding hydraulic system configured to adjust buoyancy.

Overall buoyancy can thus be adjusted as required.

It is a further advantage of the present disclosure to provide a method of drilling underwater wells in the bed of a body of water.

According to the present disclosure, there is provided a method of drilling underwater wells in the bed of a body of water; the method comprising the steps of connecting, on the body of water, an auxiliary floating unit to a jack-up having a floating structure, and a drilling installation supported by the floating structure; and transferring, on the body of water, the jack-up and the auxiliary floating unit from a first drilling station to a second drilling station.

Utilizing the auxiliary floating unit, the jack-up can be set up at otherwise unreachable shallow-water drilling stations.

In one embodiment, the method comprises the step of disconnecting the auxiliary floating unit from the jack-up.

This prevents the auxiliary floating unit from impeding operation of the jack-up when drilling.

In one embodiment of the method, the jack-up comprises a plurality of legs; and a plurality of feet, each located at the bottom end of a leg and configured to rest on the bed of the body of water; the floating structure being connected to move selectively with respect to each of the legs to vary the configuration of the jack-up between a first configuration, in which the legs only extend above the floating structure, and a plurality of second configurations, in which the legs support the floating structure on the bed of the body of water and above the surface of the body of water; and the step of connecting the jack-up to the auxiliary floating unit comprises positioning the auxiliary floating unit underneath the floating structure, and lowering the floating structure onto the auxiliary floating unit to connect the floating structure to the auxiliary floating unit. This provides for connecting the jack-up and the auxiliary floating unit relatively easily.

In one embodiment of the method, the floating structure comprises at least one seat; and the step of connecting the jack-up to the auxiliary floating unit comprises positioning part of the auxiliary floating unit inside the seat.

In various embodiments of the present disclosure, the seat can be predefined according to the overall buoyancy guaranteed by the jack-up and auxiliary floating unit as a whole.

In one embodiment of the method according to the present disclosure, the step of disconnecting the auxiliary floating unit from the jack-up comprises raising the floating structure along the legs.

The structure of the jack-up thus also provides for simplifying disconnection.

It is a further advantage of the present disclosure to increase the buoyancy of the jack-up.

According to the present disclosure, there is provided an auxiliary floating unit for a jack-up for underwater well drilling in the bed of a body of water; the jack-up having a floating structure, and a drilling installation supported on the floating structure; and the auxiliary floating unit being connectable selectively to the floating structure.

Additional features and advantages are described in, and will be apparent from the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
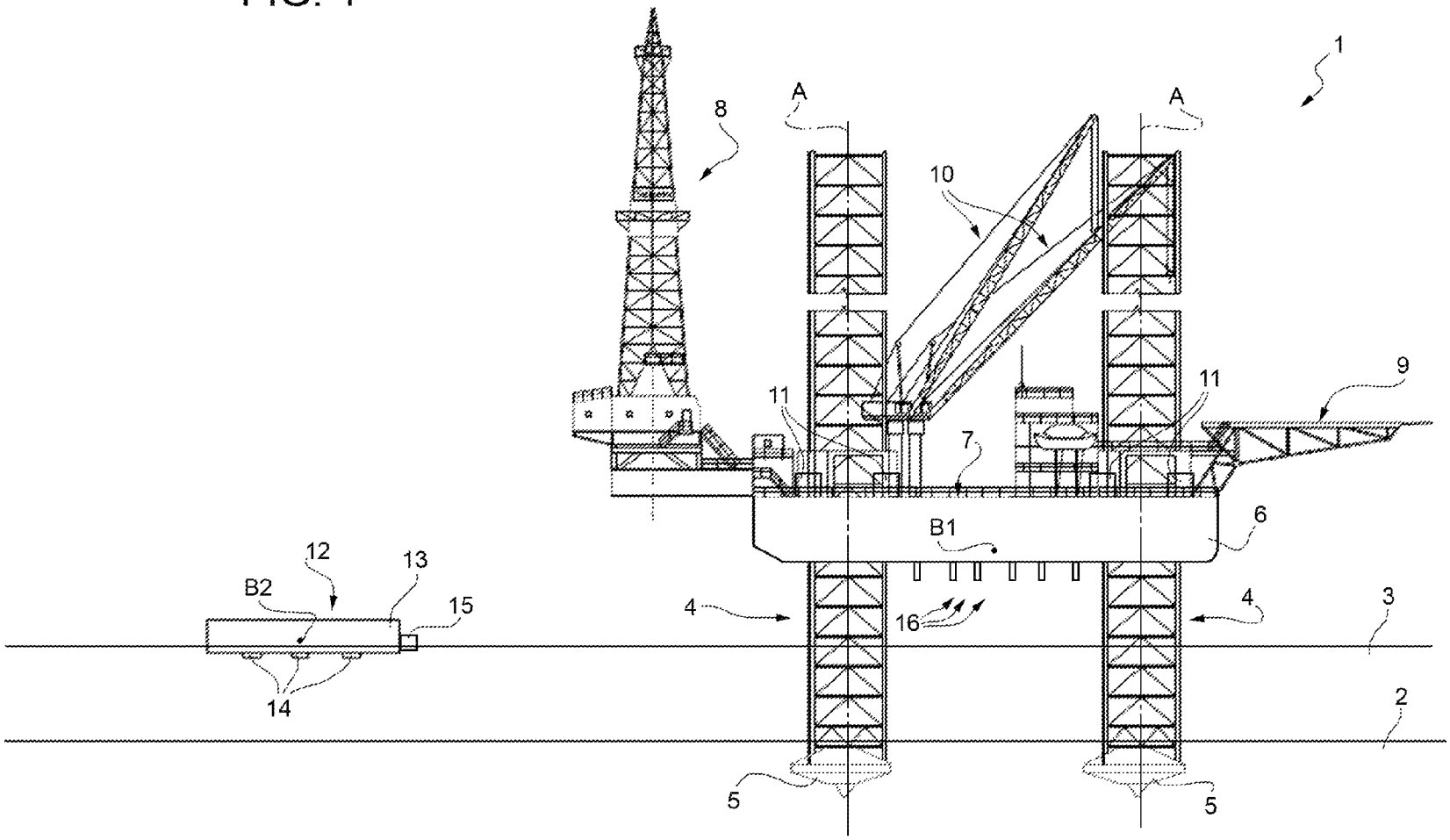
FIG. 1 shows a side view, with parts removed for clarity, of a system comprising a jack-up in a first operating position, and an auxiliary floating unit.

Referring now to the example embodiments of the present disclosure illustrated in FIGS. 1 to 6, FIG. 1 shows as a whole a system configured to drill wells (not shown) in the bed 2 of a bed of water 3, and comprising a jack-up 1 resting on bed 2 of body of water 3.

Jack-up 1 comprises a plurality of—in the example shown, three—legs 4; a plurality of feet 5, each at the bottom end of a leg 4; a floating structure 6 connected in selectively adjustable manner to each leg 4; at least one deck 7 over floating structure 6; a drilling installation 8 located on one side of and, in the example shown, projecting with respect to deck 7; a deck 9 located on the opposite side of deck 7 to drilling installation 8, and which serves as a helipad; a plurality of cranes 10 on deck 7; miscellaneous equipment, engine rooms and living quarters (not shown); and actuating devices 11, each associated with a respective leg 4 to adjust the position of leg 4 with respect to floating structure 6, and which may be hydraulic jack systems, rack-and-pinion systems, etc.

In the attached drawings, legs 4 are defined by lattice structures, but may be defined by tubular or other structures. Each leg 4 extends along an axis A, and the floating structure extends along a plane perpendicular to axis A.

The system comprises an auxiliary floating unit 12 connectable selectively to jack-up 1—more specifically, to floating structure 6—to increase the buoyancy of jack-up 1. Auxiliary floating unit 12 is actually only connected to floating structure 6 when necessary to station jack-up 1 in particularly shallow water, shallower than the minimum allowed by floating structure 6.

Figure 3:
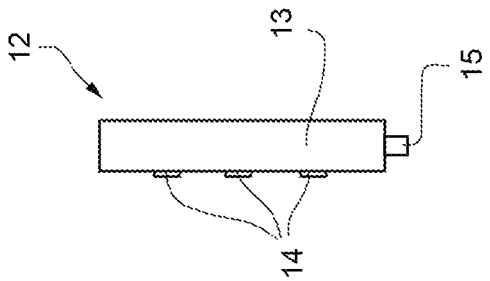
FIG. 3 shows a side view, with parts removed for clarity, of the FIG. 2 auxiliary floating unit.
Figure 2:
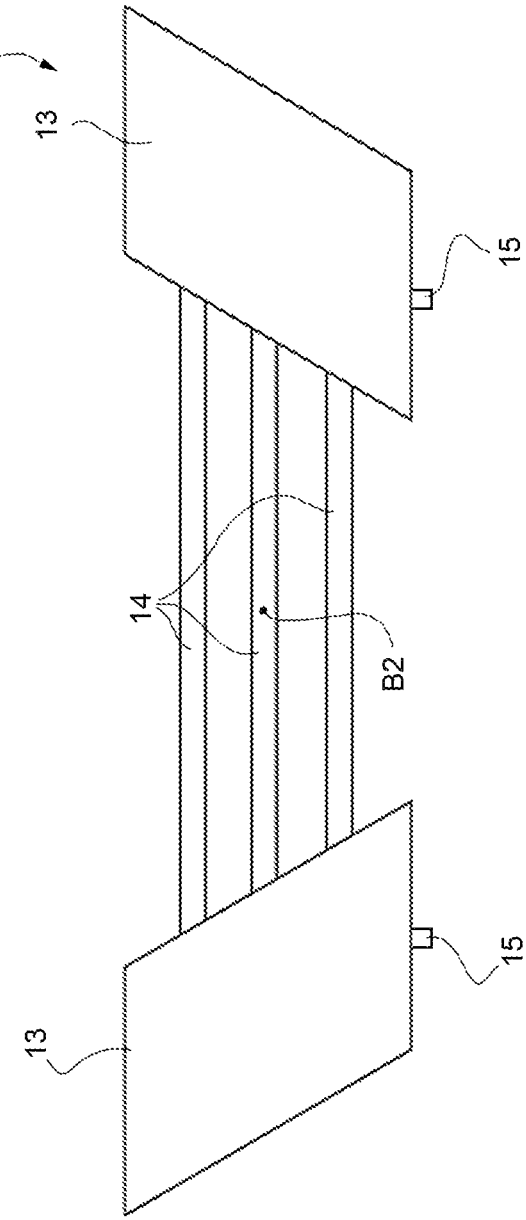
FIG. 2 shows a larger-scale plan view, with parts removed for clarity, of an auxiliary floating unit of the FIG. 1 jack-up.

As shown in FIG. 2, auxiliary floating unit 12 comprises two tanks 13 connected by three connecting members 14—in the example shown, straight beams—extending beneath tanks 13 (FIG. 3). Each tank 13 is substantially defined by a hermetically sealed metal box, and is, in one embodiment, equipped with a hydraulic system 15 by which to feed and drain water in and out of tank 13 to adjust the buoyancy of tank 13 and auxiliary floating unit 12 as a whole. In one embodiment, hydraulic system 15 is also controllable from jack-up 1. Tanks 13 are spaced apart by connecting members 14 to form a sort of cradle to house floating structure 6 (FIG. 1).

In the FIG. 2 example, each tank 13, in horizontal section, is rhombus-shaped, and the opposite faces of tanks 13 converge.

Figure 5:
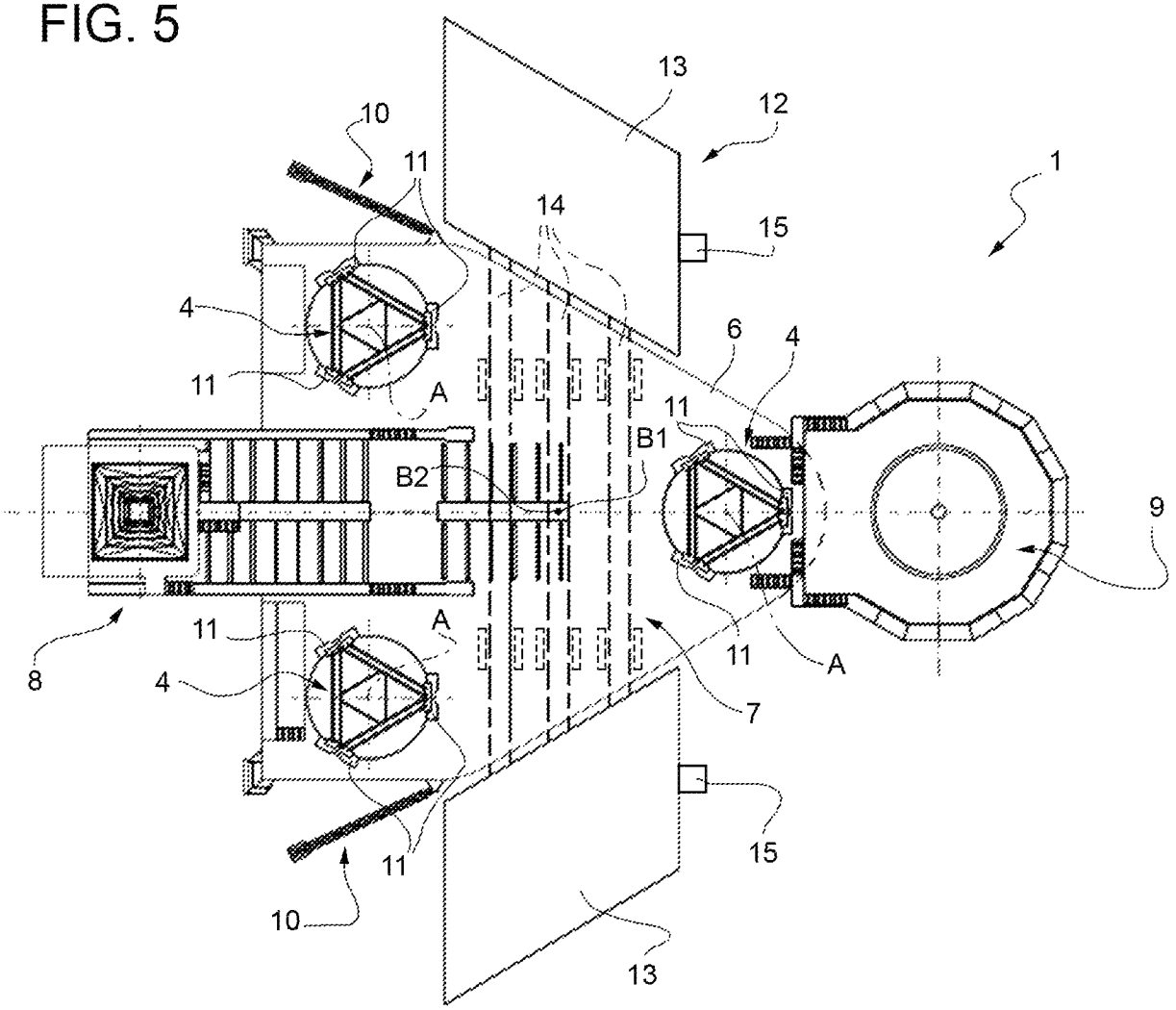
FIG. 5 shows a plan view, with parts removed for clarity, of the FIG. 4 system.

FIG. 5 shows auxiliary floating unit 12 connected to floating structure 6, which, in horizontal section, is substantially in the form of an irregular hexagon. The total mass of jack-up 1 without auxiliary floating unit 12 has a barycentre B1 aligned vertically with the buoyancy application point of floating structure 6; and auxiliary floating unit 12 has a barycentre. B2 aligned vertically with its own buoyancy application point. Floating structure 6 and auxiliary floating unit 12 are connected to ensure the stability of the system as a whole by taking into account the relative positions of the two barycentres B1, B2 and respective buoyancy application points. In the attached drawings, barycentres B1 and B2 are shown aligned vertically. Floating structure 6 and auxiliary floating unit 12 are connected by positioning auxiliary floating unit 12 beneath floating structure 6, and lowering floating structure 6 onto connecting members 14, with tanks 13 on opposite sides of floating structure 6. For which purpose (FIG. 1), floating structure 6 has seats 16 underneath configured to house connecting members 14.

In an alternative embodiment (not shown), seats are formed along the sides of the floating structure, to at least partly house the auxiliary floating unit tanks.

Precise connection is thus ensured, with barycentre B1 substantially aligned with barycentre B2.

In FIG. 1, floating structure 6 is not connected to auxiliary floating unit 12, and jack-up 1 is positioned resting on bed 2 of body of water 3. When operating in particularly shallow water is necessary, auxiliary floating unit 12 is towed, by a tugboat (not shown), into position beneath floating structure 6, and is maintained in a designated position with respect to jack-up 1. Next, floating structure 6 is lowered by actuating devices 11 to connect with auxiliary floating unit 12; and, once the two are connected, actuating devices 11 raise legs 4 into a position (FIG. 4) clearing, (i.e., not projecting from), the underside of floating structure 6.

Figure 4:
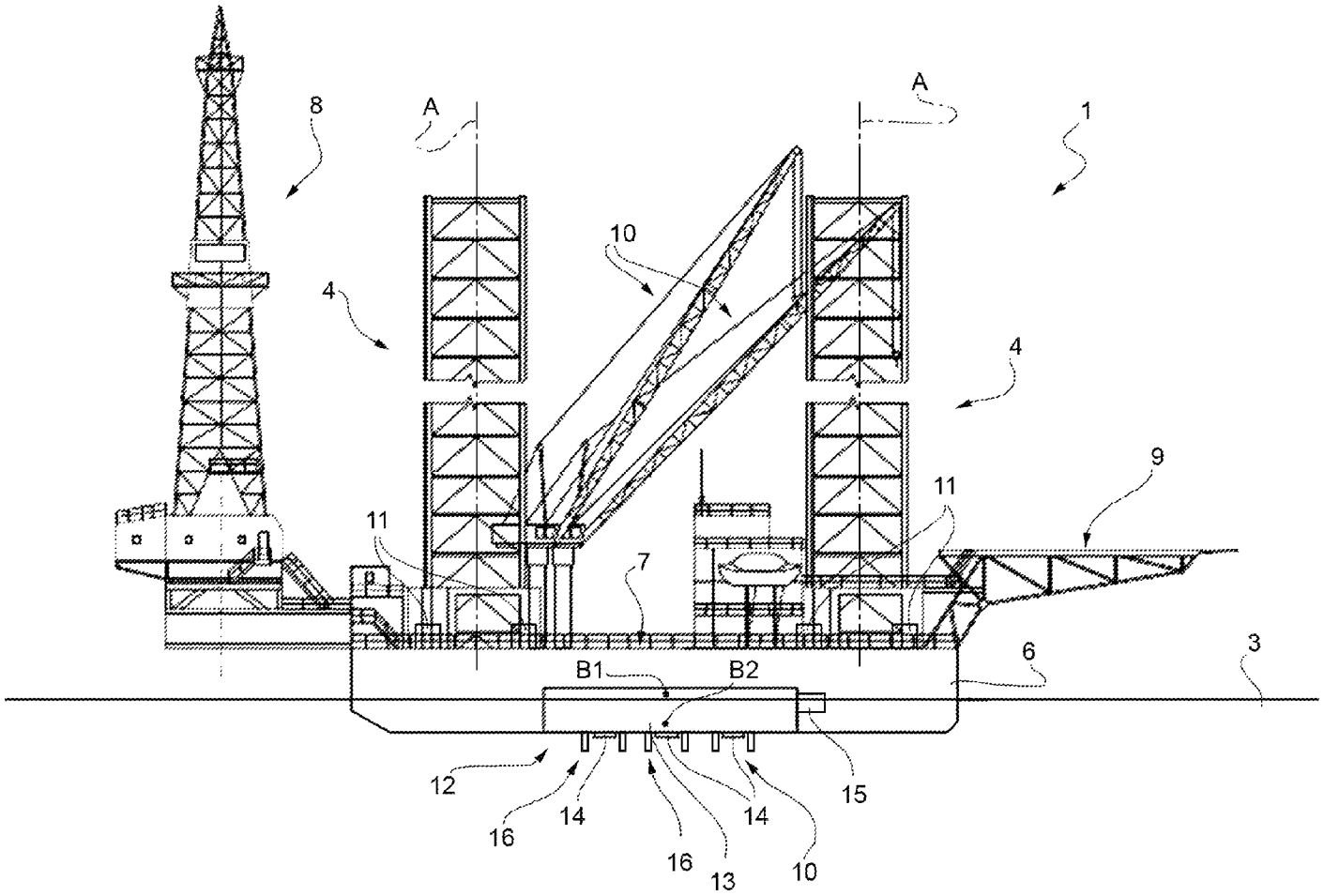
FIG. 4 shows a larger-scale side view, with parts removed for clarity, of the FIG. 1 system in a second operating position.

In the FIG. 4 configuration, the buoyancy application points of floating structure 6 and auxiliary floating unit 12 are substantially aligned vertically. And jack-up 1 and auxiliary floating unit 12 as a whole are towed, by tugboats (not shown), over body of water 3 into shallow water, as shown in FIG. 6.

Figure 6:
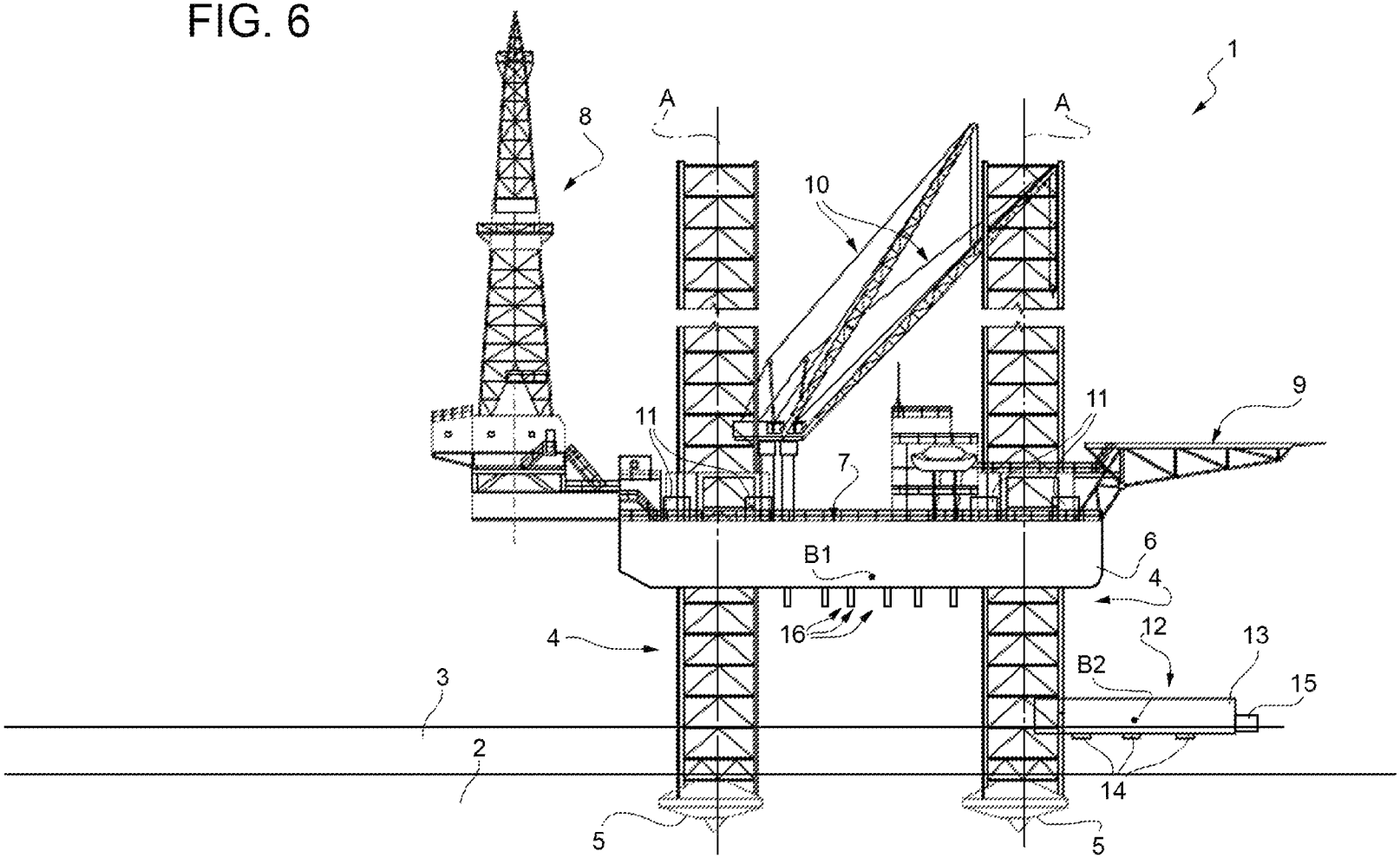
FIG. 6 shows a side view, with parts removed for clarity, of the FIG. 1 system in a further operating position.

With reference to FIG. 6, on reaching the new drilling station of jack-up 1, floating structure 6 is raised into a safe position, and feet 5 of legs 4 are positioned resting on bed 2 of body of water 3. As floating structure 6 is raised, floating structure 6 disconnects automatically from auxiliary floating unit 12.

At this point, auxiliary floating unit 12 is removed by a tugboat (not shown), and jack-up 1 is ready to commence drilling.

The system described is configured to extend the operating range of the jack-up in a reasonably simple manner.

Clearly, changes may be made to the embodiment described of the present disclosure without, however, departing from the protective scope of the accompanying Claims. That is, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An underwater well drilling system comprising:

a jack-up having:

a plurality of legs, a plurality of feet, each foot located at a bottom end of a respective one of the legs, each foot configured to rest on a bed of a body of water, a floating structure, wherein the floating structure is connected to selectively move with respect to each of the legs to vary a configuration of the jack-up between: (i) a first configuration in which the plurality of legs extend exclusively above the floating structure, and (ii) a plurality of second configurations, and a drilling installation supported on the floating structure; and an auxiliary floating unit selectively connectable to the floating structure of the jack-up such that each of the second configurations of the jack-up include the plurality of legs supporting the floating structure on the bed of the body of water and the auxiliary floating unit selectively connectable to the floating structure above the surface of the body of water, said auxiliary floating unit including:

two hermetically sealed tanks located on opposite sides of the floating structure, and at least one connecting member configured to connect the two hermetically sealed tanks to each other, said at least one connecting member being located beneath the floating structure.

2. The underwater well drilling system of claim 1, wherein the jack-up and the auxiliary floating unit are complementary in shape.

3. The underwater well drilling system of claim 1, wherein the two hermetically sealed tanks are located on opposite sides of the jack-up.

4. The underwater well drilling system of claim 1, wherein the floating structure includes a seat configured to at least partly house the auxiliary floating unit.

5. The underwater well drilling system of claim 1, wherein:

the jack-up has a first barycentre substantially aligned with a buoyancy application point of the floating structure, the auxiliary floating unit has a second barycentre substantially aligned with a buoyancy application point of the auxiliary floating unit, and the jack-up and the auxiliary floating unit are connectable as a function of the positions of: the first barycentre, the second barycentre, the buoyancy application point of the floating structure, and the buoyancy application point of the auxiliary floating unit.

6. The underwater well drilling system of claim 1, wherein the auxiliary floating unit includes at least one controlled-flooding hydraulic system configured to adjust buoyancy.

7. A method of executing an underwater well drilling program in a bed of a body of water, said method comprising:

connecting, on the body of water, an auxiliary floating unit to a floating structure of a jack-up, wherein:

(a) said jack-up has a drilling installation supported by the floating structure, a plurality of legs, and a plurality of feet, each foot located at a bottom end of a respective one of the legs, each foot configured to rest on the bed of the body of water, (b) the floating structure is connected to selectively move with respect to each of the legs to vary a configuration of the jack-up between:

(i) a first configuration in which the plurality of legs extend exclusively above the floating structure, and (ii) a plurality of second configurations, each of the second configurations include the plurality of legs supporting the floating structure on the bed of the body of water and the auxiliary floating unit selectively connectable to the floating structure above the surface of the body of water, (d) said auxiliary floating unit has two hermetically sealed tanks located on opposite sides of the floating structure, and at least one connecting member located beneath the floating structure and configured to connect the two hermetically sealed tanks to each other, and (c) said connecting the auxiliary floating unit to the floating structure of the jack-up includes:

(i) positioning the auxiliary floating unit underneath the floating structure, and (ii) lowering the floating structure onto the auxiliary floating unit to connect the floating structure to the auxiliary floating unit; and transferring, on the body of water, the jack-up and the auxiliary floating unit from a first drilling station to a second drilling station.

8. The method of claim 7, which includes disconnecting the auxiliary floating unit from the jack-up after transferring, on the body of water, the jack-up and the auxiliary floating unit from the first drilling station to the second drilling station.

9. The method of claim 7, wherein the floating structure includes at least one seat and connecting, on the body of water, the auxiliary floating unit to the jack-up includes positioning part of the auxiliary floating unit inside the at least one seat.

10. The method of claim 7, which includes disconnecting the auxiliary floating unit from the jack-up by raising the floating structure along the plurality of legs.

11. An underwater well drilling auxiliary floating unit comprising:

a body selectively connectable to a floating structure of a jack-up including a plurality of legs, a plurality of feet, each foot located at a bottom end of a respective one of the legs, each foot configured to rest on a bed of a body of water, a floating structure, wherein the floating structure is connected to selectively move with respect to each of the legs to vary a configuration of the jack-up between: (i) a first configuration in which the plurality of legs extend exclusively above the floating structure, and (ii) a plurality of second configurations each including the plurality of legs supporting the floating structure on the bed of the body of water and the auxiliary floating unit selectively connectable to the floating structure above the surface of the body of water, and a drilling installation supported on the floating structure, said body including two hermetically sealed tanks located on opposite sides of the floating structure, and at least one connecting member located beneath the floating structure and configured to connect the two hermetically sealed tanks to each other.

* * * * *